US006329926B1

(12) United States Patent
Hollander et al.

(10) Patent No.: US 6,329,926 B1
(45) **Date of Patent: *Dec. 11, 2001**

(54) VISUAL DISPLAY DEVICES

(75) Inventors: Steven Hollander, Los Angeles; Daniel Leontiev, Cerritos; Stefan Serban Nastase, Fontana, all of CA (US)

(73) Assignee: Newport Electronics, Inc., Santa Ana, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/690,857

(22) Filed: Oct. 18, 2000

Related U.S. Application Data

(63) Continuation-in-part of application No. 09/428,543, filed on Oct. 26, 1999.
(60) Provisional application No. 60/106,874, filed on Nov. 5, 1998.

(51) Int. Cl.[7] ..... G08B 5/22
(52) U.S. Cl. ..... 340/815.45; 340/815.53; 340/815.56; 340/815.65; 345/117
(58) Field of Search ..... 340/815.4, 815.45, 340/815.65, 815.53, 815.56; 368/10, 11; 345/117; 362/231 R; 600/485, 490, 493

(56) References Cited

U.S. PATENT DOCUMENTS 4,705,406 * 11/1987 Havel ..... 368/10
4,707,171 * 11/1987 Havel ..... 368/11
4,845,745 * 7/1989 Havel ..... 379/354
4,929,936 * 5/1990 Friedman et al. ..... 345/117

* cited by examiner

*Primary Examiner*—Edward Lefkowitz
*Assistant Examiner*—Davetta W. Goins
(74) *Attorney, Agent, or Firm*—William A. Drucker

(57) ABSTRACT

The invention provides visual displays, and methods of operating such visual displays, in which use is made of a plurality of light emitting diode elements which are arranged to emit a respective colour when suitably energised. Diode elements having different colours are juxtaposed so that when one or some of the juxtaposed elements are energised they show a first colour, and when others of the juxtaposed elements are simultaneously energised, the elements collectively generate a further colour or colours which is or are a derivative of their respective colours. Examples are described of use of the visual displays for such purposes as the provision of advertising materials, decorative materials, and variable background shapes, colours and textures, such as for display and furnishings. Other examples described and shown are of the use of the visual displays of the invention for operation of screens, such as television and monitor screens, wherein the displays of the invention are utilised on the same dimensional scale as the known pixels of electronic tubes. Other uses of the invention are in the fields of display of digital and analog information in electronic apparatus such as meters. The invention further provides an electronic instrument which has a display with a group of light emitting diode elements, the elements of a first portion of the group being of a first colour when energised, and the elements of a second portion being of a second colour when energised, the elements of the first portion being juxtaposed to the elements of the second portion so that when both elements are energised at the same time they collectively display a third colour which is a derivative of their respective colours.

20 Claims, 6 Drawing Sheets

VISUAL DISPLAY DEVICES

This application is a continuation-in-part of co-pending application Ser. No. 09/428,543 Filed Oct. 28, 1999 which claims priority based upon application Ser. No. 60/106874 filed Nov. 2, 1998.

FIELD OF THE INVENTION

This invention relates to the field of visual displays in which the nature of graphical, pictorial, numerical, decorative and other visual material can be changed in, for example, colour, shape, intensity, and the nature of information conveyed to a viewer.

The invention further relates to the field of electronic instruments for indicating and measuring variable parameters such as time, temperature, viscosity, and density, and for indicating states such as achievement of or regression from a limit of a variable parameter.

OBJECTS OF THE INVENTION

An object of the invention is to provide an improved visual display, incorporating a plurality of light emitting diode elements each of which is adapted to emit a respective colour when energised, in which such diode elements are juxtaposed in such a manner that by appropriate energisation of one or more of the diode elements, the diodes can be caused to display material in a manner which can be varied as to colour and/or content.

Another object of the invention is to provide methods of operating such displays for variation, of display of material, as to colour and/or content.

A still further object of the invention is to provide an electronic instrument having pairs of light emitting diode elements which, when energised, are of different respective colours and which are so arranged relative to each other that when energised simultaneously they display another colour which is a derivative of their respective colours.

A still further object of the invention is to provide an arrangement, of pairs or groups of three or more light emitting diode elements, which permits display, when the elements are energised, of almost all of the letters of the alphabet and also the numerals from "0" to "9" with a clarity hitherto obtainable only with a much great number of diode elements.

SUMMARY OF THE INVENTION

According to the invention there is provided a visual display comprising a plurality of light emitting diode elements some of which are adapted to emit a respective colour when energised, elements adapted to emit respective different colours being juxtaposed such that when at least two of said juxtaposed elements are energised they together generate a further colour which is a derivative of their respective colours.

Further according to the invention there are provided methods of operating such displays for variation of the display as to colour and/or content of the display. According to another feature of the invention there is provided an electronic instrument having a display comprising a group of light emitting diode elements, the diode elements of a first portion of the group being of a first colour when energised, the diode elements of a second portion of the group being of a second colour when energised, the respective individual diode elements of the first portion of the group being each juxtaposed to a respective individual diode element of the second portion of the group such that when both of the juxtaposed diode elements are energised at the same time they collectively display a third colour which is a derivative of their respective colours.

DETAILED DESCRIPTION OF THE DRAWINGS

Figure 1:
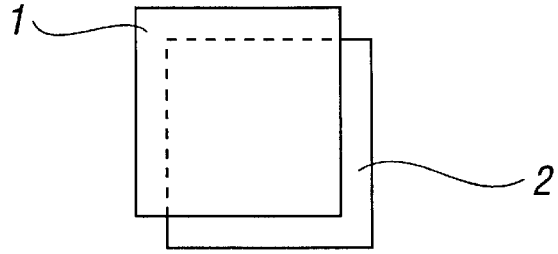
FIG. 1 is a front elevation of a pair of light emitting diodes, here shown in slightly offset position for ease of illustration.

Referring to FIG. 1 of the drawings there is shown an assembly of light emitting diodes elements 1 and 2 which are disposed one behind the other. In this Figure they are shown offset slightly, but in practice would be aligned one behind the other. The respective light emitting diodes are constructed to display respectively two different colours when energised, for example one red and one green, or any other pair of colours obtainable with such diodes. In this simple example of construction, the pair of diodes will present to the viewer a red colour when only the front diode 1 is energised, and only a green colour (seen through the transparent front diode 1) when the rear diode 2 is energised, or again a third colour, which is a resultant of the mixing of red and green, when both of the diodes are energised at the same time.

Figure 2:
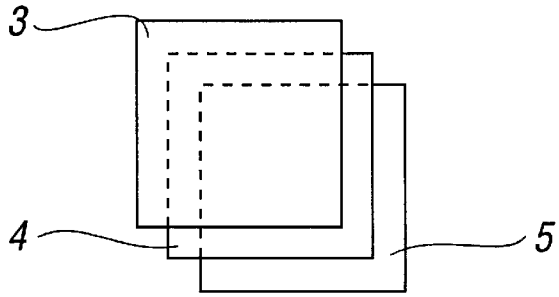
FIG. 2 is a front elevation of three light emitting diodes, here shown in slightly offset position for ease of illustration.

Referring now to FIG. 2, there is shown an assembly of three light emitting diodes 3,4,and 5, each of which is constructed to have a respective different colour when energised, say for example red for diode 3, white for diode 4, and green for diode 5, and according as to whether a single diode is energised, or a pair of diodes, or all three diodes, are energised at the same time, there will be a single primary colour, or a resultant colour, displayed by the assembly.

Figure 3:
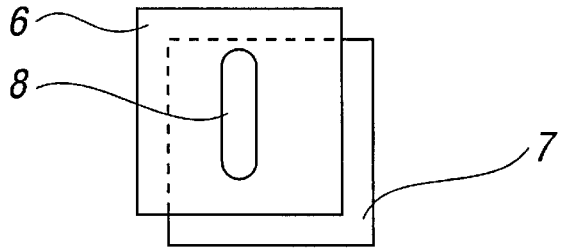
FIG. 3 is a front elevation of a pair of light emitting diode, the front one of which has an aperture through which the rear one can be directly viewed, the front and rear diodes being offset slightly for ease of illustration.

Referring now to FIG. 3 of the drawings there is shown an assembly of light emitting diodes 6 and 7 both of which are constructed to have a respective different colour when energised. The front diode 6 is formed with an aperture 8 through which the rear diode 7 is permanently visible. The aperture 8 could be, for example, a letter of the alphabet, or a numeral, or any other desired indication and could be plural. When only the front diode 6 is energised, the aperture 8 is shown up as having only a basic (non-energised) colour of the rear diode 7. If only the rear diode 7 is energised, then the aperture 8 shows up in the respective colour of the rear diode. If both of the diodes are energised at the same time, the aperture 8 shows up as a shape in a first colour (i.e. that of the diode 7) against a background of the resultant of the respective colours of the two diodes.

Figure 4:
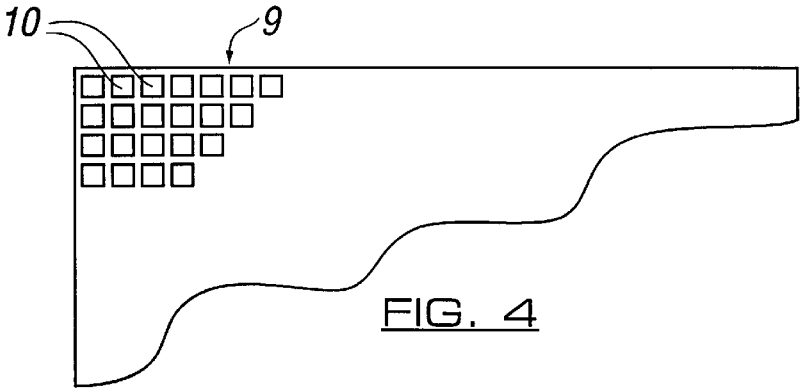
FIG. 4 is a partial front elevation of a screen, such as a monitor screen or a television screen, in which a plurality of pairs or assemblies of light emitting diodes, such as for example those shown in FIGS. 1,2 and 3, are arranged over the face of the screen similarly to the manner in which known pixels are arranged in conventional screens.

The diodes, in a further embodiment, are placed closely side by side as distinct from being one behind another. It is to be noted that the diodes can readily be made very small compared with the dimensions of filament-type light bulbs. Referring now to FIG. 4 of the drawings, there is shown a panel or screen 9, such as for example the screen of a television tube or of a monitor, in which a very large number of assemblies 10 of light emitting diodes are provided. The assemblies of diodes are made very small, i.e. of a size comparable to the pixels currently utilised in the art of such tubes and monitors. The assemblies of diodes are arranged to be energised in any convenient manner so that, according to the extent to which all or a selection of the diodes of each assembly are energised, different colours will be imparted so that the screen can be made to display any required form of information, picture, background colour, pattern or the like. Such a screen can thus be utilised in similar manner to the known electronic display tubes. By way of example the diodes, in a further embodiment, are arranged to permit the creation of a picture having, inter alia, black area(s), white area(s), and area(s) showing, according to their energisation, two, three or more colours.

Figure 5:
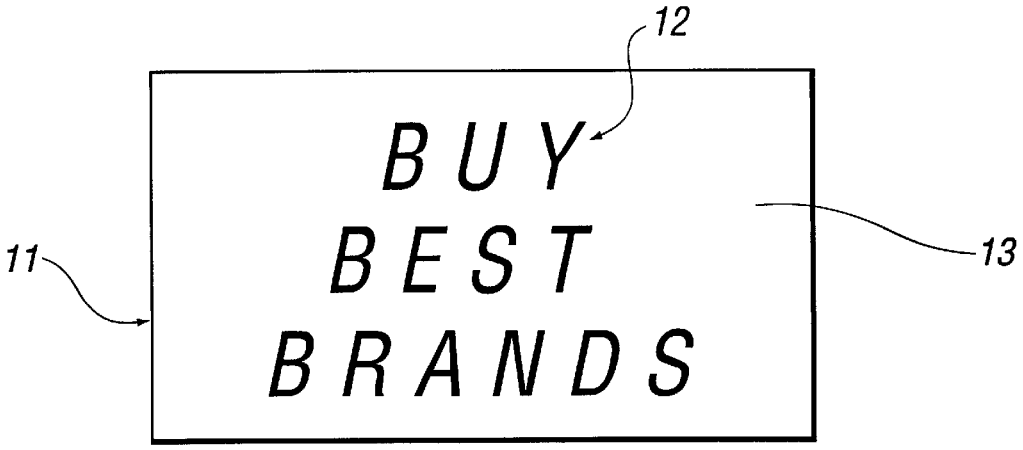
FIG. 5 is a front elevation of an advertisement or announcement board, containing pairs or assemblies of light emitting diodes as shown in FIGS. 1 to 3.

Referring now to FIG. 5 there is shown a screen or display panel 11 which is again formed, in similar manner to that of FIG. 4, of a large number of small assemblies of light emitting diodes, for example in accordance with the description of FIGS. 1,2 or 3. On the scale of this drawing the individual assemblies are not illustrated. Some or all of the assemblies of diodes are connected to a source of energisation which can selectively illuminate individual assemblies in such a manner that a message, picture or other representation 12 can be made visible against a background 13 which may be either the natural, i.e. non-energised colour of the assemblies which constitute the background, or any selected one colour, or pattern of colours, according to the energisation provided. The diodes projecting the message, picture, or other representation, and the diodes providing the background, can be made to vary continuously or from time to time, and the message, picture or representation can be changed from time to time as desired, by suitably varying the energisation of those assemblies.

Figure 6:
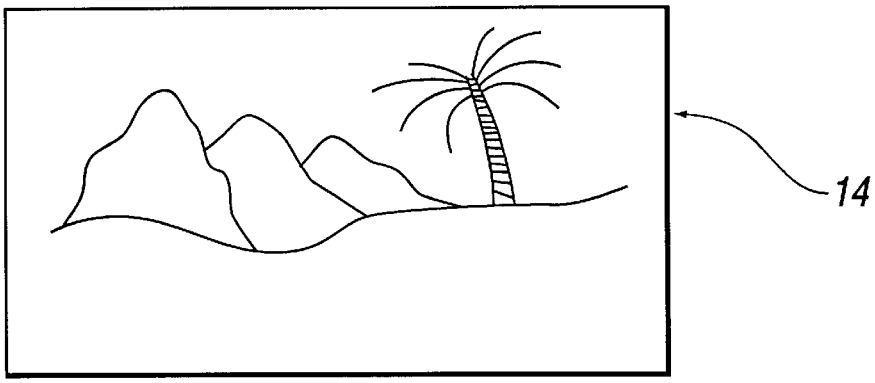
FIG. 6 is a front elevation of a decorative panel, or picture containing pairs or assemblies of light emitting diodes as shown in FIGS. 1 to 3.

Referring now to FIG. 6 of the drawings, there is shown a structure 14, for example a picture to be placed on a wall, which has on its surface a large number of assemblies of light emitting diodes, as described with reference to any of FIGS. 1 to 3, which are individually connected to an energising source which provides a showing, which may change from to time, of an artistic item such as a view, and the colour of the items of the view, and of the remainder of the item, e.g. the background to the view, may be caused to change from time, or vary, for example to simulate the changing of daylight to moonlight.

Figure 7:
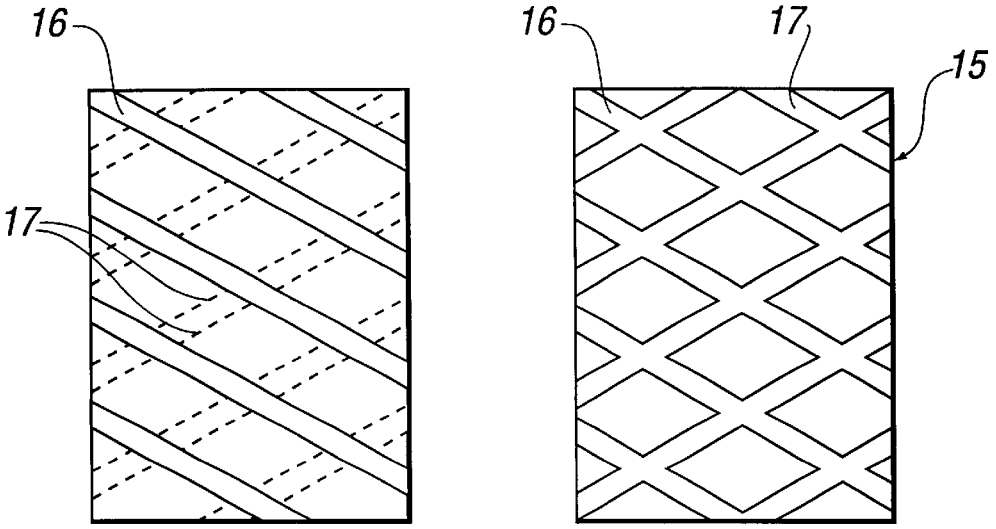
FIG. 7 is a front elevation of another form of decorative panel, containing pairs or assemblies of light emitting diodes as shown in FIGS. 1 to 3, in which a pattern is changeable between two forms shown respectively in the left-hand and right-hand portions of the Figure.

Referring to FIG. 7 of the drawings, there is shown a decorative panel 15 which, for purposes of illustration, is in right-hand and left-hand halves to denote different stages of operation. The panel 15 is composed of a large number of assemblies of light emitting diodes, as described with reference to FIGS. 1,2 and 3. The left hand portion of the panel, in this drawing, shows the panel in a first state of operation in which certain diagonal lines 16 of diodes are energised, and in which other diagonal lines 17 are not energised. In the right hand portion of the illustration of the panel, both the diagonal lines 16 and the diagonal 17 are energised simultaneously.

Figure 8:
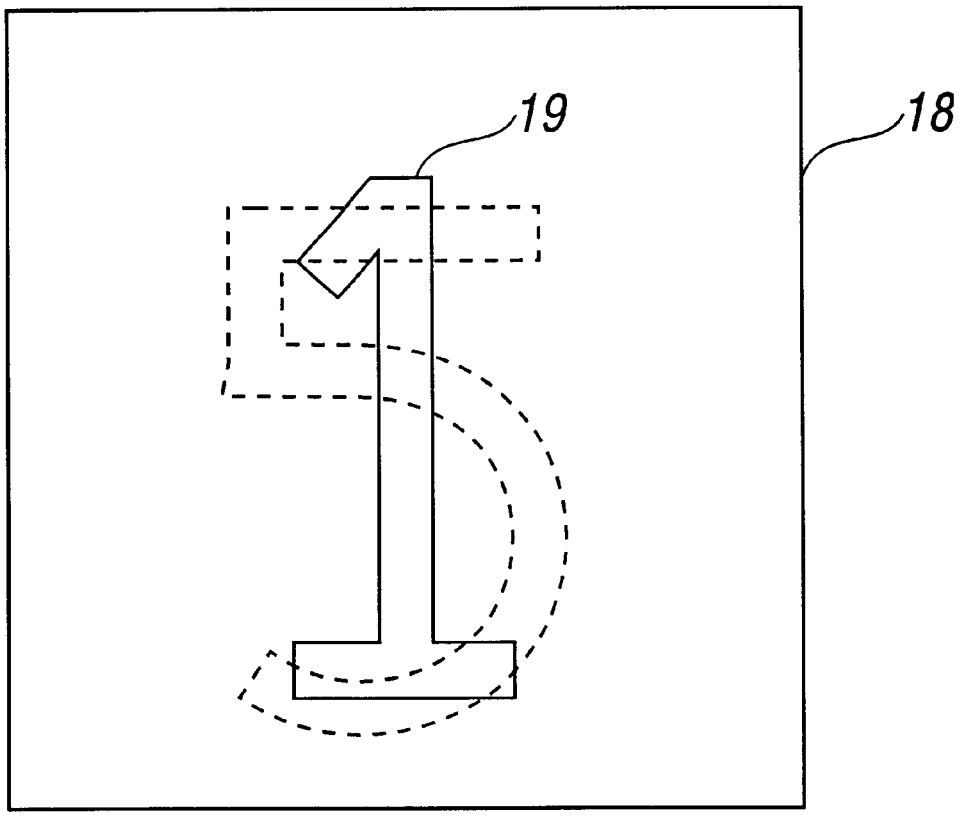
FIG. 8 is a front elevation of an indicator panel, containing pairs of assemblies of light emitting diodes as shown in FIGS. 1 to 3, in which the diodes are operable in such a manner as to present to view an item of information, such as number, which can be changed as desired.

Referring to FIG. 8 of the drawings, there is shown a numerical sign or indicator 18 which is composed of a large number of the diode assemblies of FIGS. 1,2 or 3. The sign or indicator may, for example, form part of an electronic meter or other read-out device, which may include a plurality of such signs or indicators, e.g. a temperature measuring device. According to the selective energising of certain of the diode assemblies, the read-out device may be caused to display, for example, any selected numeral or letter of the alphabet or other sign 19 appropriate to the circumstances of use. In this Figure, the read-out device is indicating the numeral "1", and by changing the selective energising of the diodes, can be made to display, say, the numeral "5" or any other desired symbol.

Figure 9:
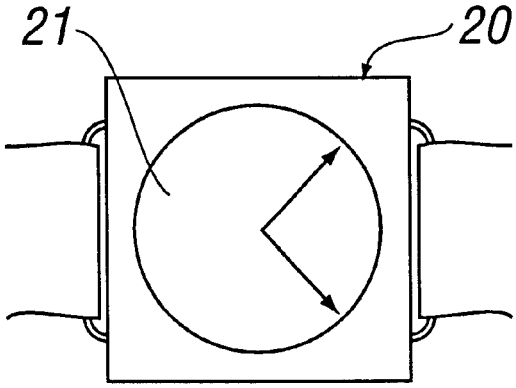
FIG. 9 is a partial front elevation of a representative wrist watch or meter face in which the face is composed of, or includes, pairs or assemblies of light emitting diodes as shown in FIGS. 1 to 3, and in which the hours and minutes or other technical data can be indicated either permanently, or from time to time.

Referring to FIG. 9 of the drawings, there is shown part of a representative meter or wrist watch 20 which has a dial face 21 composed of, or furnished with, a number of the diode assemblies described with reference to FIGS. 1,2 and 3. For example, the dial face may have a circle of the diodes arranged in the position normally occupied by the hour and minute indications of a dial, or a display of digital information such as a technical parameter. According to a first construction, as illustrated, only the diode assemblies which from time to time correspond with the positions of the minute hand and of the hour hand become illuminated. According to a modification, the diode assemblies corresponding to the usual minute and hour indications all around the dial are illuminated, and the colouring of such assemblies may be changed from time to time, e.g. at one second intervals, to provide an interesting and attractive facia. The diode assemblies, in a further embodiment, are arranged to show digital information, as distinct from the analog information in the example illustrated.

Figure 10:
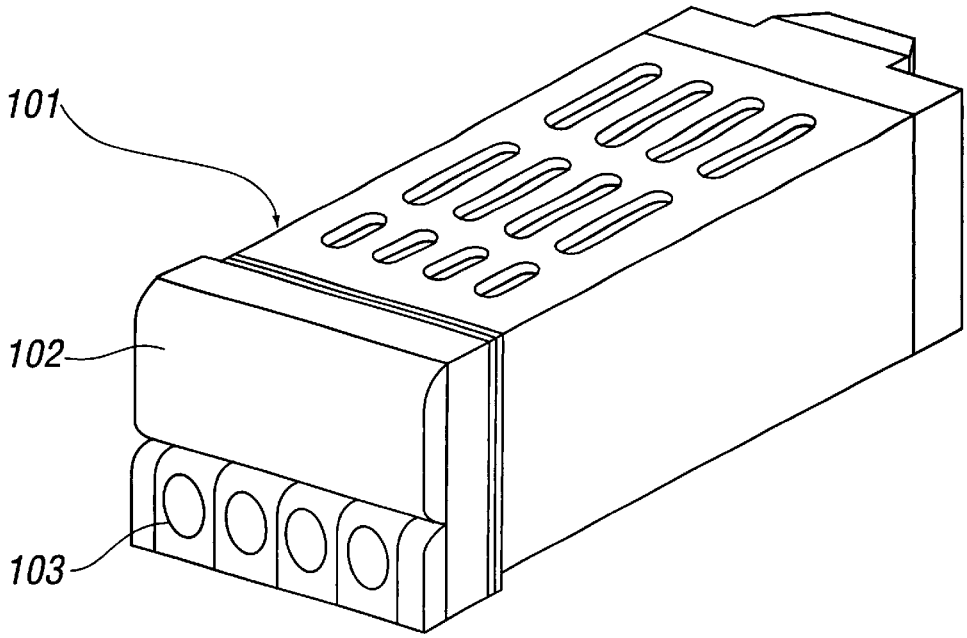
FIG. 10 is a perspective elevation, from the front and one side, of an electronic instrument such as a meter or controller.
Figure 11:
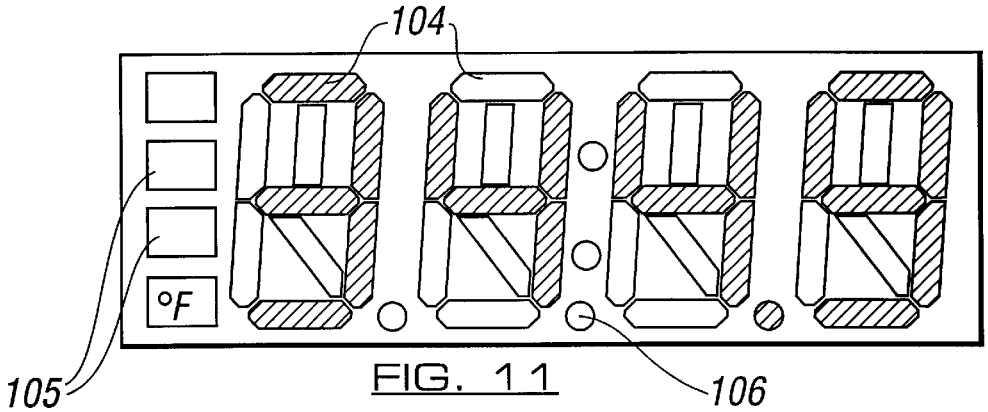
FIG. 11 is a front elevation of a screen of the instrument of FIG. 10 to show an example of indication of temperature.
Figure 12:
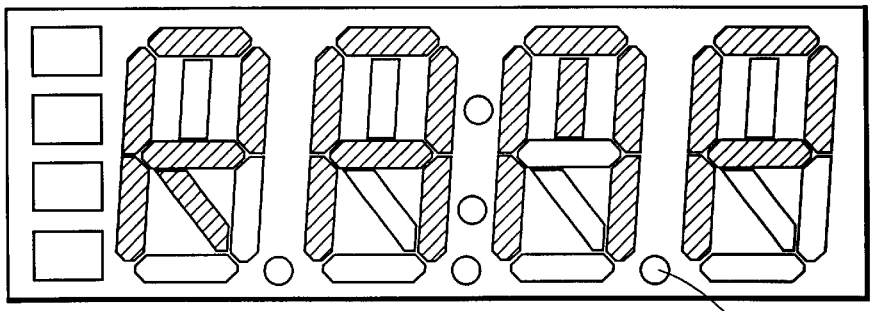
FIG. 12 is a front elevation of the screen of the instrument of FIG. 10 to show an example of indication of function.

Referring now to FIG. 10 of the drawings, there is shown an electronic instrument 101, such as a meter for indicating a number of parameters, or a controller for controlling for example steps in a process or operation. At the front end of the instrument there is a screen structure 102, and a plurality of controls 103, such as push button switches. Referring to FIGS. 11 and 12 of the drawings, the screen structure 102 has four groups of light emitting diode elements 104, and four indicator panels 105 to serve, for example, to show the nature of a parameter which is being indicated or controlled.

In FIG. 11, the screen 102 with its light emitting diode elements 104, is indicating a temperature of 344.9 degrees Fahrenheit.

Figure 13:
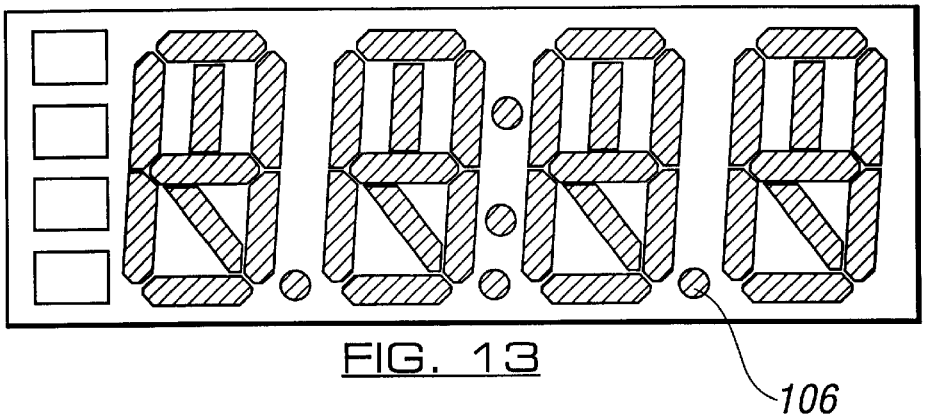
FIG. 13 is a front elevation of the screen of the instrument of FIG. 10 to represent the appearance of the groups of light emitting diode elements when the colour is red.
Figure 14:
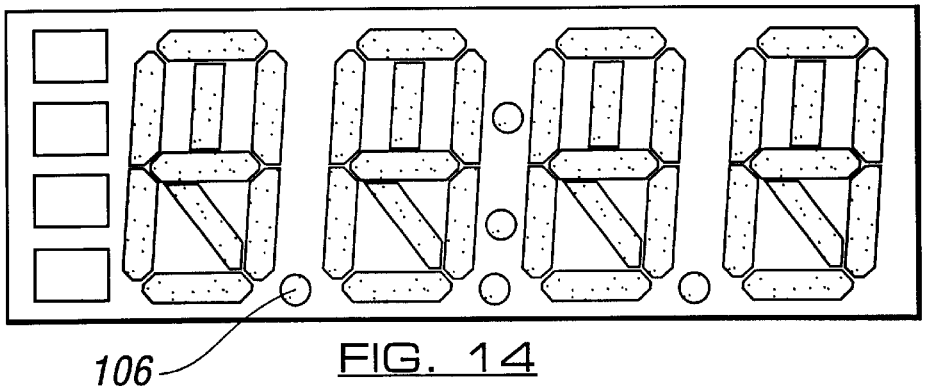
FIG. 14 is a front elevation of the screen of the instrument of FIG. 10 to represent the appearance of the groups of light emitting diode elements when the colour is amber.
Figure 15:
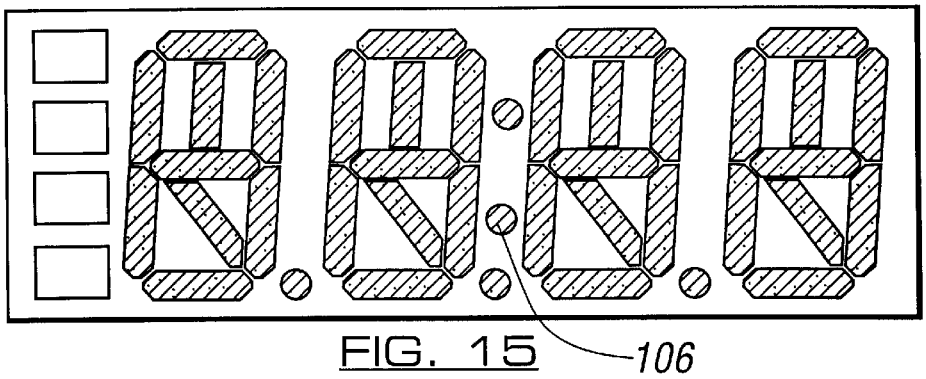
FIG. 15 is a front elevation of the screen of the instrument of FIG. 10 to represent the appearance of the groups of light emitting diode elements when the colour is green.

In FIG. 12, the screen 102 with its light emitting diode elements 104, is indicating a function "RAMP". Referring to FIGS. 13,14 and 15 of the drawings, FIG. 13 is entitled to indicate, by the shading of the light emitting diode elements, that they are showing red as a colour. In FIG. 15, the shading is intended to indicate that they are showing green in colour. In FIG. 14, the colours red and green are combined to show the colour amber.

In FIGS. 11,12,13,14 and 15 the light emitting diode elements 106 are provided at a number of positions to permit the showing of, for example, decimal points, full stops, and colons, which may flash.

Figure 16:
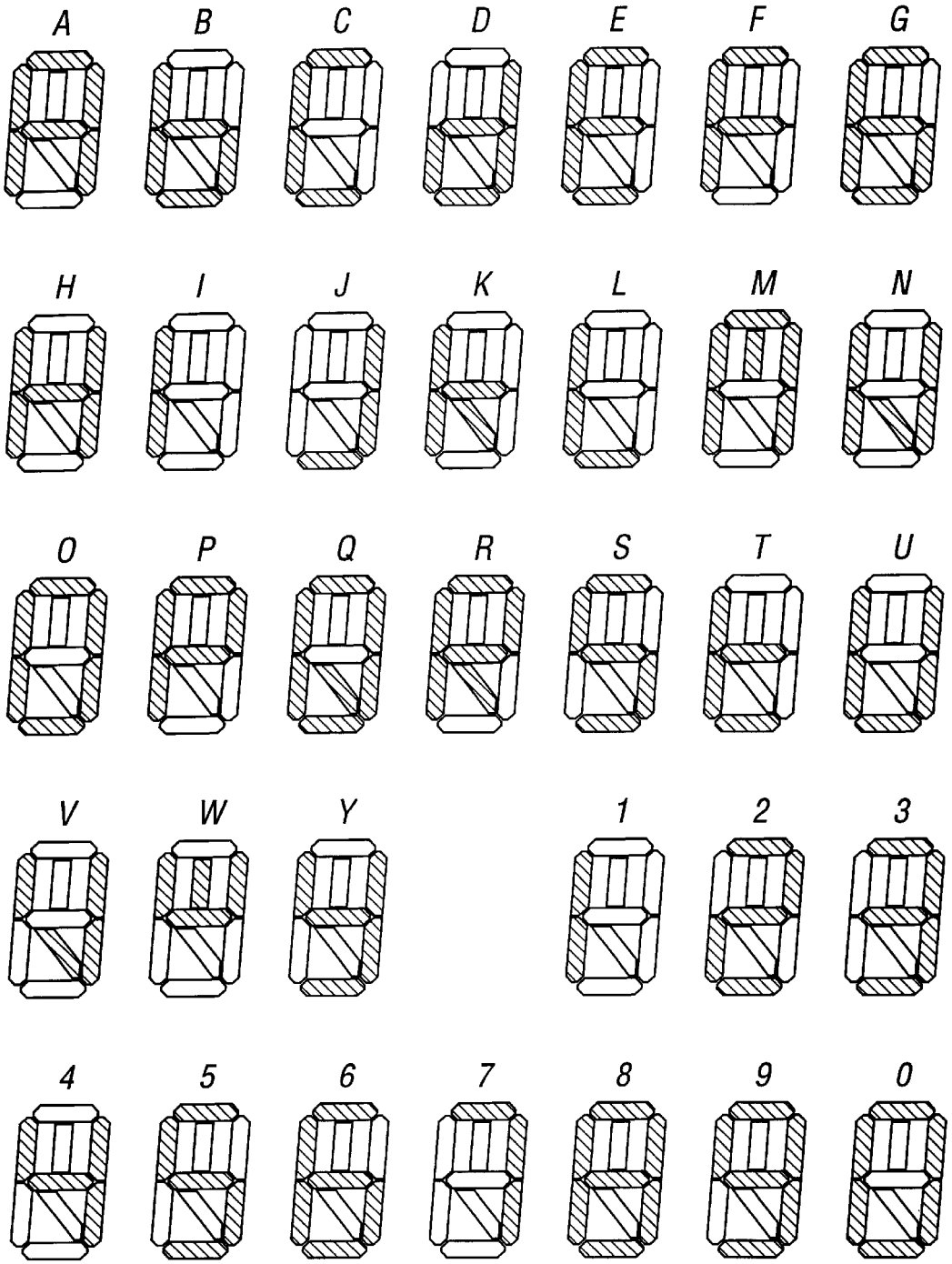
FIG. 16 shows the manner in which nine elements of a group of light emitting diode elements can be used to form all of the letters of the alphabet, with the exception of the letters "X" and "Z", and to form all of the numbers from "0" to "9"

Referring to FIG. 16 of the drawings, there are shown illustrations of the manner in which nine individual light emitting diode elements can be selectively illuminated to indicate all of the letters of the alphabet with the exception of the letters "X" and "Z", and all of the numbers from "0" to "9".

The use of four groups of light emitting diode elements 104 is by way of example only, and in a further embodiment any desired number of such groups are provided on a screen structure 102, and arranged in any other desired formation, such as stacked vertically or disposed in a circle or in any other figure.

As described above, the light emitting diode elements are selected with the two colours "red" and "green", so as to combine, when desired, to form a third colour "amber".

The electronic circuitry required to power and to switch light emitting diode elements is well known in the electronics art, and has not been described herein. The feature provided by the present invention is that there is a choice, within the same screen structure, to show each of three or more colours, and to change the manner in which they occur. By way of example, if the electronic instrument is a temperature indicator, the screen may have its light emitting diode elements all coloured green so long as the temperature being measured or indicated is within a certain limit. The arrangement can then be that if the temperature being measured or indicated passes above a desired norm, the colour of the light emitting diode elements changes to amber. Still further, if the temperature being measured or indicated goes still higher and exceeds a predetermined safety level, the colour of the light emitting diode elements then changes to red. The changes in colour may be quickly and easily seen from a distance so that for example an operator in charge of a machine or process can quickly react to the changing indications and conditions. Similarly it the temperature subsequently passes below the safety limit, the colour can be caused to change back again to amber, and with a still further reduction of the temperature, can change back to green.

In a further embodiment, the electronic instrument is programmed to display, permanently, only a selected one of the three or more colours, so that when a plurality of the instruments are used, say three in number, one of them may permanently display red, another may permanently display amber, and a third may permanently display green, for example to indicate three parameters such as temperature, pressure and flow.

In yet another embodiment, the instrument is programmed so that when a selected colour is achieved, that colour is "latched on" until an appropriate change in the indicated parameter is provided by an operator in charge, or by other control circuitry.

The invention permits the construction of meters, controllers, indicators, and other viewing screens of smaller size than was possible hitherto, by reason of use of a nine-element formation which gives a 24 letter alphabet. A meter having a fourteen diode element display would be much larger and cost more than a nine element display. A seven element device does not permit obtaining anything near to a full alphabet. Read-out and indicator devices of the present invention are of advantage for vehicle dash-board use, cockpit use in aviation, and like environments having only small space availability, whilst nevertheless necessitating clear vision.

The number of elements in each of the light emitting diode groups, in the example shown in FIG. 16, is nine as distinct from the seven or fourteen elements known hitherto, and permits provision of almost all of the letters of the alphabet and any desired numerical indication, at a greater brightness and clarity, and very much smaller size, than was available hitherto The use of nine diode elements provides a letter display which is easier for the user to understand than a display which is obtained with only seven diode elements. A further advantage of the nine diode element display of this invention is that the letters and numbers of the display can be made of a lesser height, for example 10mm., and the use of a lesser number of diode elements permits the width of the individual diode elements to be greater, in a given display length.

In still further embodiments, the light emitting diode elements are grouped, additionally to or in substitution of the alphabet and any numerals, so as to provide other indicator signs such as plus and minus signs, shapes used in the chemical and physical arts, and letters of exotic alphabets.

In the drawings, the light emitting diode groups are shown as forming part of a linear instrument face, and in a further embodiment the elements are provided in a circular formation to resemble, for example, a clockface or a circular meter face. In still further embodiments both digital-type and analog-type indicators are provided.

In a still further embodiment of the invention there are utilised three or more colours of light emitting diode elements, to permit obtaining of further distinct colours and/or shades of any desired colour.

In yet another embodiment, use is made of three light emitting diode elements in combination, which permits obtaining of 256 colours. A greater number still of light emitting diode elements provides the possibility of obtaining "full colour" display.

In a still further embodiment of the invention, the strength of illumination of one or more of the light emitting diode elements is made variable, to permit obtaining of degrees of brightness and/or variation of the combined colour obtained.

The invention, in a still further embodiment, provides the use of the light emitting diode elements in a pattern or design, as distinct from alpha-numeric indications.

In a still further embodiment, a plurality of light emitting diode elements are set in line vertically one above another to stimulate the conventional mercury or spirit thermometer tube, with for example the lower portion being made to show green, a higher central portion being made to show amber, and an uppermost portion being made to show red, the whole being for use as a temperature indicator.

Figure 17:
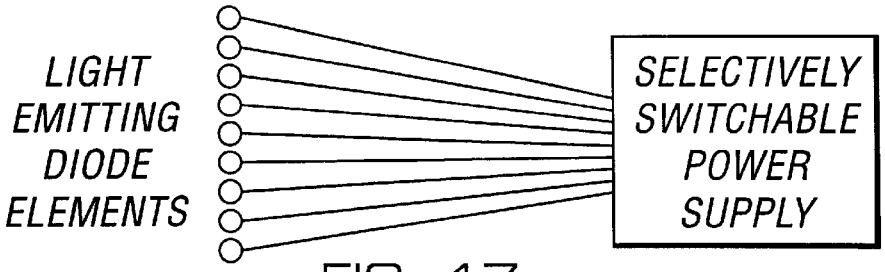
FIG. 17 is a block diagram to show a selectively switchable power supply for the elements of a group of light emitting diodes.

Referring to FIG. 17 there is shown a block diagram to illustrate the selective supplying of power to elements of a group of light emitting diode elements. The diode elements of each group are in "die form" side by side within a reflective housing.

We claim:

1. A visual display comprising a plurality of light emitting diode elements each of which is adapted to emit a respective colour when energised, elements adapted to emit respectively different colours being juxtaposed such that when at least two of said juxtaposed elements are energised they together generate a further colour which is a derivative of their respective colours.

2. An electronic instrument having a display comprising a group of light emitting diode elements, the diode elements of a first portion of the group being of a first colour when energised, the diode elements of a second portion of the group being of a second colour when energised, the respective diode elements of the first portion of the group being juxtaposed to a respective individual diode element of the second portion of the group such that when both of the juxtaposed elements are energised, they collectively display a third colour which is a derivative of their respective colours.

3. A visual display comprising a plurality of light emitting diode elements each of which is adapted to emit a respective colour when energised, the diode elements being arranged in a plurality of groups according to the colour which they emit, the groups being juxtaposed such that when the elements of at least two of such groups are concurrently energised they together generate a further colour which is a derivative of the respective colours of the elements of said at least two groups.

4. A visual display, as claimed in claim 3, wherein elements of at least a first of such juxtaposed groups are windowed to display the colour of a least a still lower group of the superposed groups.

5. A visual display, as claimed in claim 3, having at least three groups of elements superposed, the elements of each group being adapted to display a respective different colour when energised.

6. An electronic monitor screen comprising a transparent support, and a plurality of visual displays as claimed in claim 1, said displays being mounted on said support and substantially covering the viewing area of said screen.

7. An information display comprising a support, and a plurality of visual displays as claimed in claim 1, said displays being mounted on said support and covering a viewing area of said support.

8. A decorative illustration comprising a support, and a plurality of visual displays as claimed in claim 1 mounted on said support and arranged to provide a decorative effect.

9. A patterned covering comprising a support, and a plurality of visual displays as claimed in claim 1 disposed on the surface of and covering an exposed area of said support.

10. A digital display device comprising a support carrying a plurality of visual displays as claimed in claim 1, and electronic means connected to said visual displays for energising selected groups of diode elements to provide an indication of digital information on the display device.

11. A data indicator comprising a facia, a plurality of visual desplays as claimed in claim 1 mounted on said facia, and electronic means connected to said visual displays for energising selected groups of diode elements to provide data information on said facia.

12. An electronic instrument having a display comprising a group of light emitting diode elements, the diode elements of a first portion of the group being of a first colour when energised, the diode elements of a second portion of the group being of a second colour when energised, the respective individual diode elements of the first portion of the group being juxtaposed to a respective individual diode element of the second portion of the group such that when both of the juxtaposed elements are simultaneously energised they collectively display a third colour which is a derivative of their respective colours.

13. An electronic instrument, as claimed in claim 12, wherein the light emitting diode elements are disposed to indicate an alpha-numeric symbol.

14. In combination, in an electronic instrument as claimed in claim 12, a group of light emitting diode elements, means for selectively energising the diode elements of the first portion of the group, means for selectively energising the diode elements of the second portion of the group, and means for selectively energising simultaneously and separately the diode elements of the first and of the second portions of the group.

15. An electronic instrument, as claimed in claim 12, wherein the diode elements of the first portion of the group are coloured red when energised, and the diode elements of the second portion of the group are coloured green when energised, such that when the elements of both groups are energised simultaneously their combined colour is amber.

16. An electronic instrument, as claimed in claim 12, wherein each group consists of nine diode elements.

17. The method of operating an electronic instrument having a group of light emitting diode elements, the diode elements of a first portion of the group being of a first colour when energised, the diode elements of a second portion of the group being of a second colour when energised, the respective individual diode elements of the two groups being juxtaposed, said method comprising steps of energising the diode elements of the first group to cause the juxtaposed elements to display a first colour, energising the diode elements of the second group to cause the juxtaposed elements to display a second colour, and energising simultaneously the elements of the first and second groups to cause the juxtaposed elements to display a third colour which is a derivative of the first and second colours.

18. The method of making a visual display which comprises steps of:

(a) providing plurality of light emitting diode elements each of which is adapted to emit a respective colour when energised, (b) juxtaposing numbers of said elements, adapted to emit respectively different colours when energised, said juxtaposed elements being selected such that when at least two of said juxtaposed elements are energised at the same time the elements in juxtaposition together generate a further colour which is a derivative of the respective colours of the at least two juxtaposed elements.

19. The method of operating a visual display having juxtaposed light emitting diode elements each of which is adapted to emit a respective different colour when energised, in which method selectively first said light emitting diode elements are energised to display a first respective colour, second said light emitting diode elements are energised to display a second respective colour, and said first and second light emitting diode elements are simultaneously energised to display collectively a further colour which is a derivative of said first and second colours.

20. In a method of operating a display having a plurality of light emitting diode elements, each of said elements being adapted to emit a respective colour when energised, the improvement characterised by:

(a) disposing in juxtaposition at least two said elements each adapted to emit a respective different colour when energised, (b) selectively energising said elements adapted to emit a first colour when energised, energising said elements adapted to emit a second colour when energised, and energising said first elements and said second elements simultaneously to cause the juxtaposed elements collectively to emit a further colour which is a derivative of their respective colours.

* * * * *